US007172435B2

(12) United States Patent
Chen

(10) Patent No.: US 7,172,435 B2
(45) Date of Patent: Feb. 6, 2007

(54) DISPLAY DEVICE STRUCTURE WITH CIRCUIT BOARD SECURED TO DISPLAY PANEL AND METHOD OF SECURING CIRCUIT BOARD TO PANEL THEREOF

(75) Inventor: Chi-Mi Chen, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 11/030,769

(22) Filed: Jan. 7, 2005

(65) Prior Publication Data

US 2006/0128179 A1 Jun. 15, 2006

(30) Foreign Application Priority Data

Dec. 14, 2004 (TW) ..... 93138716 A

(51) Int. Cl.
*H01R 12/00* (2006.01)

(52) U.S. Cl. ..... 439/76.1; 439/66; 349/149; 361/681

(58) Field of Classification Search ..... 439/76.1, 439/892, 66–67; 349/149; 361/748, 681
See application file for complete search history.

(56) References Cited

U.S. PATENT DOCUMENTS 5,358,412 A * 10/1994 Maurinus et al. ..... 439/66
5,774,199 A * 6/1998 Ozawa ..... 349/149
6,091,474 A * 7/2000 Middleton et al. ..... 349/149
6,181,404 B1 1/2001 Gaffney ..... 349/149
6,358,065 B1 * 3/2002 Terao et al. ..... 439/67
6,392,873 B1 * 5/2002 Honda ..... 361/681
6,583,831 B2 * 6/2003 Kim ..... 349/58
6,594,143 B2 * 7/2003 Yano et al. ..... 361/681
6,671,012 B1 12/2003 Tanaka ..... 349/58
2003/0011973 A1 * 1/2003 Jeong ..... 361/681
2004/0070721 A1 * 4/2004 Tsubokura et al. ..... 349/149
2004/0169782 A1 * 9/2004 Lai et al. ..... 349/58

* cited by examiner

*Primary Examiner*—Michael C. Zarroli
(74) *Attorney, Agent, or Firm*—Thomas, Kayden, Horstemeyer & Risley

(57) ABSTRACT

A display and a method of coupling at least one circuit board to a panel of the display. The display comprises a frame mounted on the display panel. The frame comprises a first body and a second body perpendicularly connected to the first body. The circuit board is coupled to the first body via the second body is not covered by the frame. At least one shield element is coupled to the frame to cover the circuit board.

16 Claims, 5 Drawing Sheets

DISPLAY DEVICE STRUCTURE WITH CIRCUIT BOARD SECURED TO DISPLAY PANEL AND METHOD OF SECURING CIRCUIT BOARD TO PANEL THEREOF

The invention relates to a method of coupling a circuit board to a panel of a display, and in particular to a method of coupling to a circuit board that facilitates maintenance of the circuit board.

In general, in a display, particularly in a liquid crystal display, a circuit board is disposed on the back of a panel to receive power or image signals. A conventional method of securing a circuit board to a panel is shown in FIGS. 1*a* and 1*b*. Circuit boards 10 and 20 are fixed on a frame 30 by bolts with electronic elements on the circuit boards facing the frame 30, and the frame 30 having circuit boards 10 and 20 attached thereon is mounted to the panel 40. Circuit boards 10 and 20 are located between the frame 30 and the panel 40 and covered by the frame 30. If maintenance or replacement of the electronic elements on the circuit boards 10 or 20 is desired, the panel 40 must be detached from the display at first, the frame 30 must be detached from the panel 40, and the circuit boards 10 and 20 must be detached from the frame 30 so as to access the electronic elements on the circuit boards 10 and 20. This dissembling method is complicated and maintenance or part replacement is time consuming. In addition, because the locations of power and/or signal connectors on the circuit board are varied based on different designs, various frame designs are required.

SUMMARY

A display according to the invention comprises a panel, a frame and at least one circuit board. The frame with at least one circuit board attached thereon is mounted to the panel, wherein a part of the frame is located between the panel and the circuit board. Thus maintenance of the electronic components (not shown in the picture) mounted on the circuit board can be performed from the back of the panel directly without dissembling the frame and the circuit board from the panel.

The frame comprises a first body and a third body separated from the first body by a predetermined distance, and the circuit board is either coupled only to the first body, or to both the first and third bodies. Even though the locations of the power connector and signal connector may vary, some part of the frame can still be used as long as the panel size is the same.

The frame further comprises a second body connected to the first body, and the circuit board is coupled to the first body via the second body. The second body can either be soldered to the first body, or integrally formed with the first body.

BRIEF DESCRIPTION OF THE DRAWINGS

The invention can be more fully understood by reading the subsequent detailed description and examples with references made to the accompanying drawings, wherein.

DETAILED DESCRIPTION

Figure 1A:
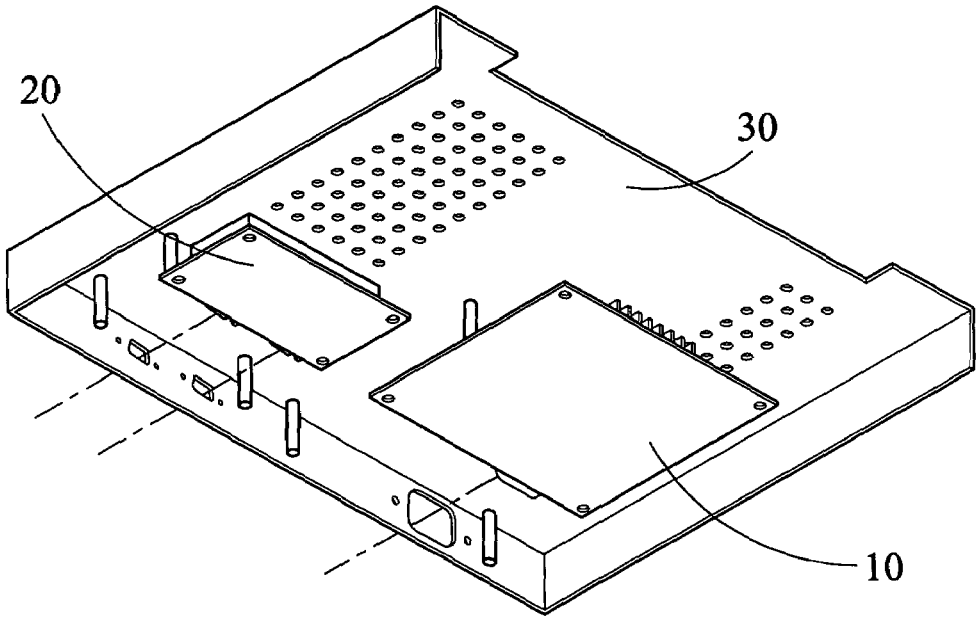
FIG. 1a ( RELATED ART )
FIGS. 1*a* and 1*b* are schematic views of a conventional method of securing a circuit board to a panel.
Figure 1B:
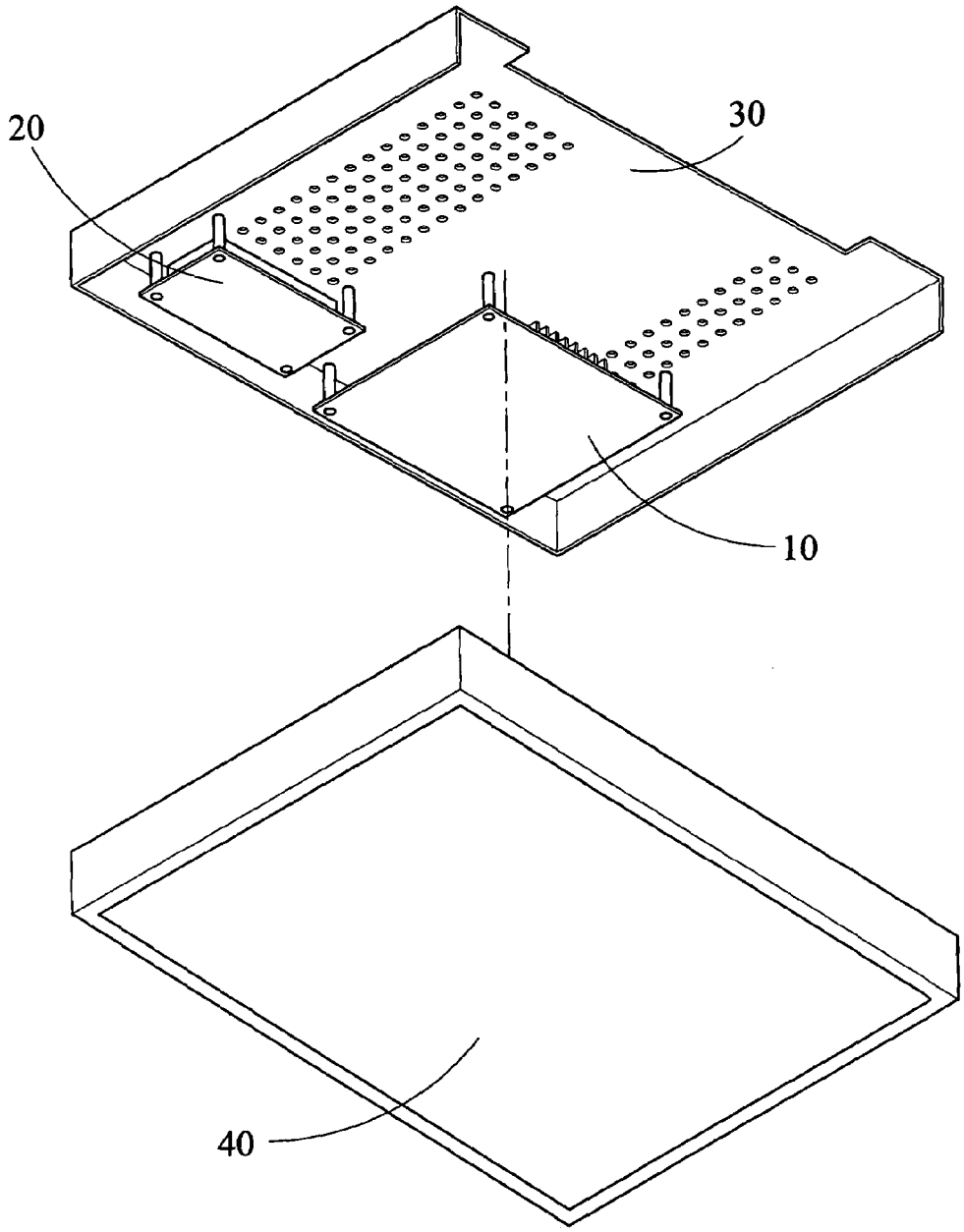
FIG. 1b ( RELATED ART )
Figure 2A:
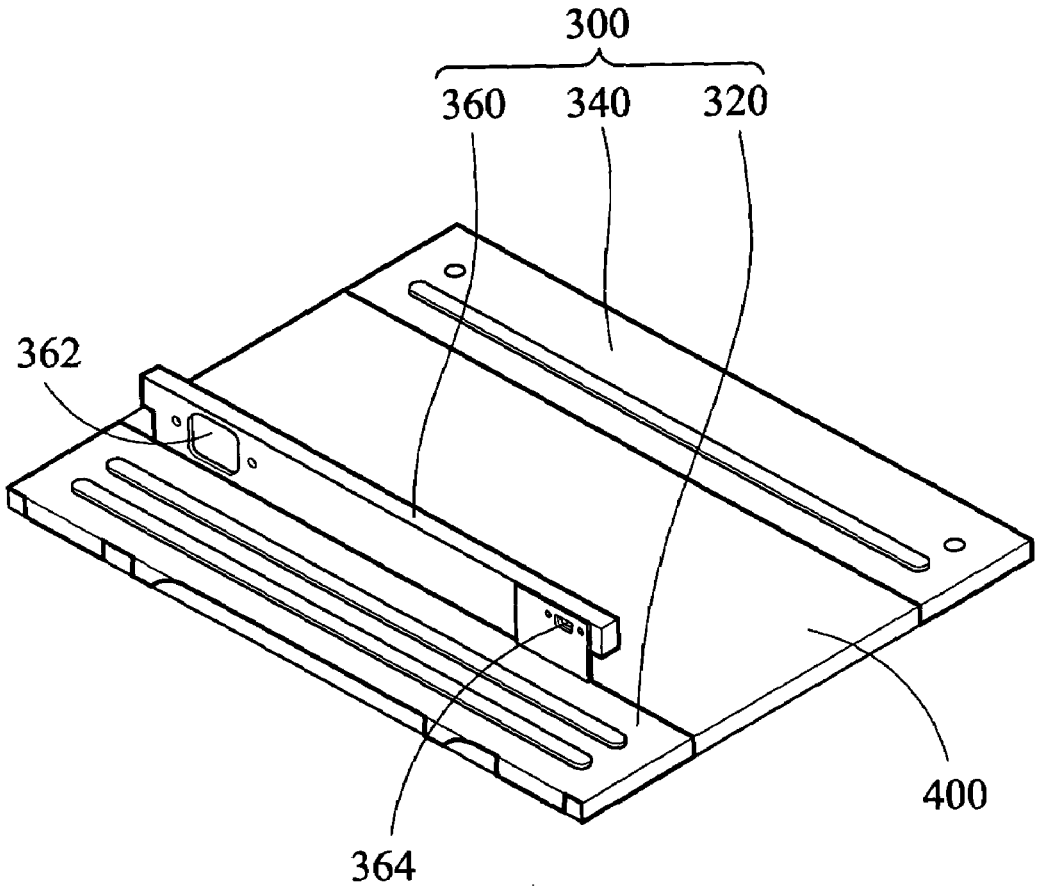
FIGS. 2*a*, 2*b* and 2*c* are schematic views depicting a method of coupling a circuit board to a panel according to an embodiment of the invention.
Figure 2B:
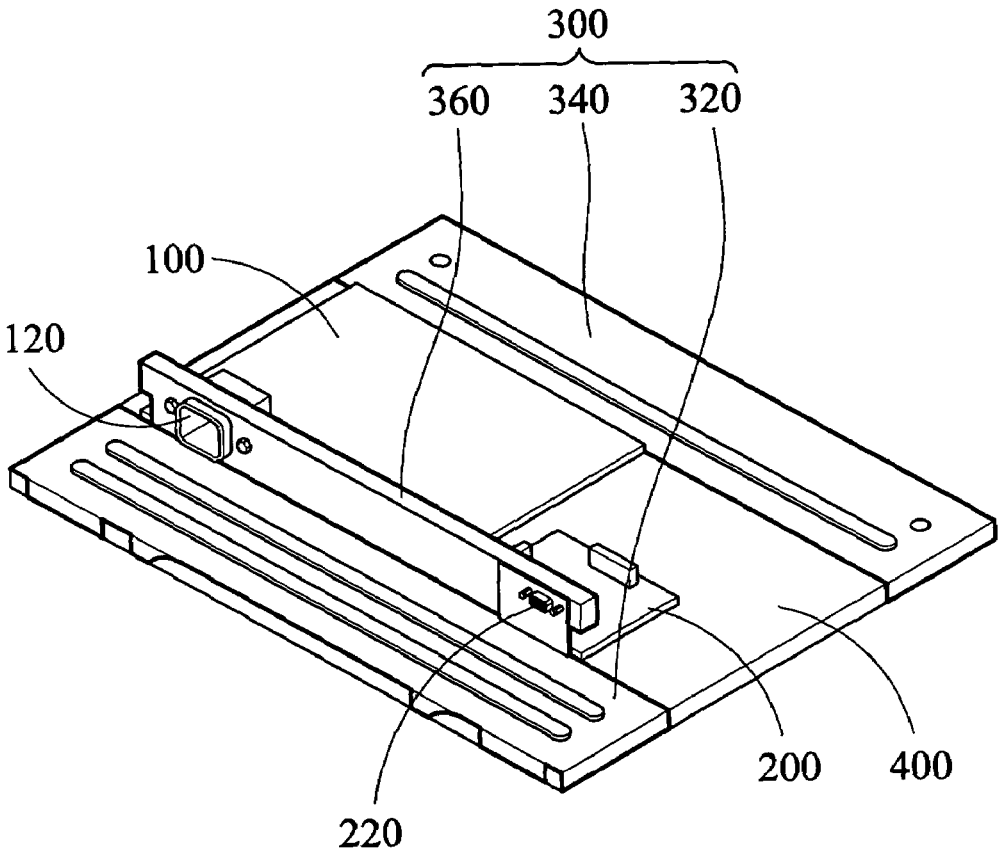
Figure 2C:
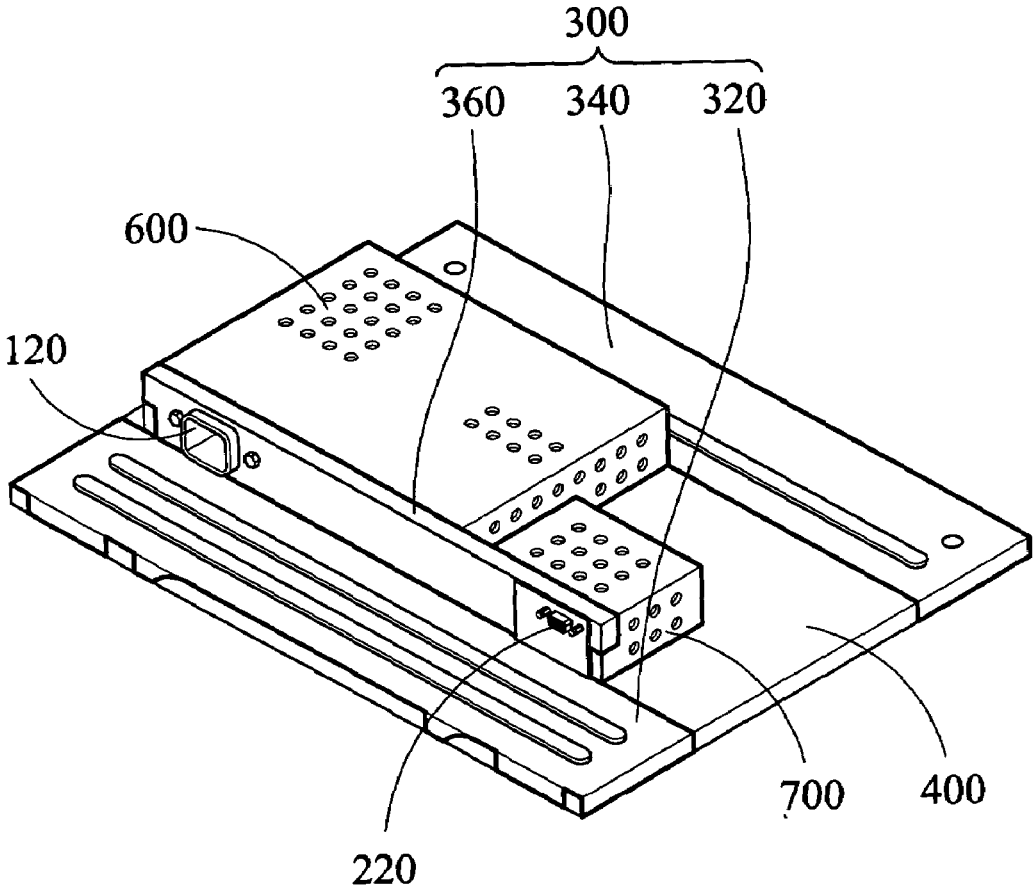

FIGS. 2*a*, 2*b* and 2*c* show a method of coupling a circuit board to a panel according to an embodiment of the invention. Reference numeral 400 in the figure represents a panel of a display. For simplicity, depiction of other parts of the display is omitted.

A frame 300 is provided to have circuit boards 100 and 200 mounted to the panel 400. The frame 300 comprises a first body 320, a third body 340 and a second body 360. The first and third bodies 320 and 340 are mounted on two opposite sides of the panel 400 with a predetermined distance therebetween. The second body 360 is connected to the first body 320 (for example by soldering or integrally forming) and perpendicular thereto.

Circuit boards 100 and 200 are mounted to the frame 300 respectively by fasteners such as bolts, screw, etc. The circuit board 100 is mounted to the frame 300 with one side attached to the second body 360 and another side attached to the third body 340, whereas the circuit board 200 is only mounted to the second body 360. The respective sides of the circuit boards 100 and 200 without electronic elements face the panel 400. Openings 362 and 364 are provided on the second body 360 to accommodate a power connector 120 of the circuit board 100 and a signal adapter 220 of the circuit board 200.

According to FIGS. 2*b* and 2*c*, shields 600 and 700 can be secured to the frame 300 to cover the circuit boards 100 and 200 respectively from electromagnetic interference. Specifically, the circuit boards 100 and 200 are only covered with the shields 600 and 700 rather than the frame 300.

If maintenance or replacement of electronic components on the circuit boards 100 and 200 is desired, the circuit boards 100 and 200 can be accessed only by removing the shield elements 600 and 700 without dissembling the panel 400 from the display, since the circuit boards 100 and 200 are not covered by the frame 300, whereby the operation of maintenance or replacement can be simplified. In such a structure, only the position of the openings 362 and 364 on the second body 360 have to be modified for different designs, whereas the third body 340 can be used without any modification as long as the panel has the same size, thereby reducing the cost incurred by manufacturing different frames.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method of assembling a at least one circuit board to a display panel of a display device, comprising the steps of:

providing a frame comprising a first body and a second body perpendicularly connected to the first body;

securing the frame to the display panel; and assembling the circuit board to the first body by first connecting to the second body, wherein the circuit board is not covered by the frame on any major side.

2. The method as claimed in claim 1, wherein the frame further comprises a third body separated from the first body by a predetermined distance.

3. The method as claimed in claim 2, wherein the method further comprises a step of: securing the circuit board to the first and the third body.

4. The method as claimed in claim 1 further comprising a step of:

securing a shield to the frame to cover the circuit board.

5. A display device, comprising:

a display panel;

a frame mounted on the display panel and comprising a first body and a second body perpendicularly connected to the first body; and at least one circuit board coupled to the first body by being connected to the second body first, wherein the circuit board is not covered by the frame on any major side.

6. The display device as claimed in claim 5, the frame further comprises a third body separated from the first body by a predetermined distance.

7. The display device as claimed in claim 6, wherein the circuit board is coupled to the first and third bodies.

8. The display device as claimed in claim 5 further comprising at least one shield contacting the frame and covering the circuit board.

9. A display device, comprising:

a display panel;

a frame joined to opposite edges of the display panel; and at least one circuit board directly connected to the frame, wherein the circuit board is not covered by the frame on any major side.

10. The display device as claimed in claim 9, wherein the frame comprises a first body, a second body connected and perpendicular to the first body, and a third body separated from the first body by a predetermined distance.

11. The display device as claimed in claim 10, wherein the circuit board is coupled to the first body.

12. The display device as claimed in claim 11, wherein the circuit board is coupled to the first body by being connected to the second body first.

13. The display device as claimed in claim 10, wherein the circuit board is coupled to the first and third bodies.

14. The display device as claimed in claim 9, wherein the display device is applied to TV or monitor or notebook.

15. The display device as claimed in claim 9 further comprising at least one shield contacting the frame and covering the circuit board.

16. The display device as claimed in claim 15, wherein the circuit board comprises a maintainable or replaceable electronic components mounted on a side of the circuit board faced toward to the shield.

* * * * *